United States Patent [19]

Hibbitts et al.

[11] 4,253,474

[45] Mar. 3, 1981

[54] METHOD FOR EXPANDING TOBACCO

[75] Inventors: Charles H. Hibbitts; Byron F. Price, both of Chester; Everett C. Cogbill; James G. Kelly, both of Richmond; James E. Glass, Sutherland, all of Va.

[73] Assignee: American Brands, Inc., New York, N.Y.

[21] Appl. No.: 892,316

[22] Filed: Mar. 31, 1978

[51] Int. Cl.[3] ..... A24B 3/18

[52] U.S. Cl. ..... 131/140 P

[58] Field of Search ..... 131/140 P

[56] References Cited

U.S. PATENT DOCUMENTS 1,201,510 10/1916 Schuyler ..... 426/450

3,214,928 11/1965 Oberdorfer ..... 131/140 P

FOREIGN PATENT DOCUMENTS 1443309 7/1976 Fed. Rep. of Germany ..... 131/140 P

*Primary Examiner*—V. Millin

*Attorney, Agent, or Firm*—Pennie & Edmonds

[57] ABSTRACT

The invention relates to a method for expanding particles of cured tobacco by means of liquid and gaseous carbon dioxide which is sprayed into a mass of the tobacco in a closed pressure vessel. The thus treated tobacco is removed from the vessel and heated such that rapid release of the carbon dioxide effects expansion of the tobacco.

13 Claims, 3 Drawing Figures

METHOD FOR EXPANDING TOBACCO

BACKGROUND OF THE INVENTION

1. Field of the Invention

The present invention relates to a method for expanding tobacco by spray impregnating cut tobacco particles in a pressure vessel with liquid and gaseous carbon dioxide following which the impregnated tobacco particles are heated to effect rapid release of the carbon dioxide with corresponding expansion of the particles.

2. Description of the Prior Art

The tobacco art has long recognized the need to effect the greatest possible degree of expansion of tobacco while maintaining desirable handling and smoking characteristics. Correspondingly, numerous attempts have been made in the art to effect such expansion of tabacco, frequently by treatment of the tobacco with an agent which expands greatly during evaporation or after a decrease in pressure.

One attempt in the prior art to expand tobacco is disclosed in U.S. Pat. No. 1,789,435 wherein a method is described for expanding the volume of tobacco in order to make up the loss of weight caused in curing the tobacco leaf. The tobacco is contacted with a gas such as air, carbon dioxide, or steam under pressure and, upon release of the pressure, the tobacco tends to expand limitedly between 5% and 15% by volume.

Prior art disclosures are also available which teach that tobacco may be expanded by addition of water to the tobacco which causes the tobacco to swell following which the contained moisture is evaporated to set the expansion.

Another attempt to expand tobacco has been by use of carbohydrates as a means to improve puffing of tobacco stems. In this process the tobacco stems are soaked in an aqueous solution of carbohydrate following which they are heated to set the tobacco expansion.

Volatile organic liquids have also been disclosed in the prior art as means to effect expansion of tobacco.

Methods have also been proposed in the prior art to effect tobacco expansion by use of ammonia and carbon dioxide gases. Carbon dioxide has also been used in the liquid state as a means of expanding tobacco and other organic substances. Typically, such processes require immersing the organic substance or tobacco in a pool of liquid carbon dioxide wherein tobacco particles are steeped in the liquid carbon dioxide following which the tobacco particles are heated, preferably using superheated steam to effect expansion. These methods, however, invite various disadvantages by requiring large quantities of liquid carbon dioxide relative to the amount of carbon dioxide which is impregnated within the tobacco particles. Furthermore, components of the tobacco such as flavoring materials may be extracted by the use of excess liquid carbon dioxide.

Although numerous attempts have been made in the prior art to expand tobacco by various means, these attempts have achieved limited success by either requiring expanding agents which have been alleged to cause environmental pollution or are otherwise costly or cumbersome to operate. it has now been found that, by practice of the present invention, tobacco may be expanded by means of liquid carbon dioxide in a simple, efficient and highly economical manner.

SUMMARY OF THE INVENTION

Generally stated, the present method for expanding tobacco requires spraying tobacco particles in a presure vessel with carbon dioxide and thereby effecting impregnation of the tobacco with carbon dioxide, following which the impregnated tobacco is removed from the de-pressurized vessel and heated to effect rapid release of the carbon dioxide with corresponding expansion of the tobacco particles.

The apparatus of the present invention includes a vertically disposed vessel having inlet and outlet pressure containing valves and a liquid carbon dioxide conduit having a multiple number of outlets along the body portion which causes a liquid spray of carbon dioxide to pass into a mass of tobacco particles contained within the vessel. The liquid carbon dioxide conduit is connected to appropriate valve and pressure regulators to an external source of liquid carbon dioxide.

Practice of the present invention will become more readily apparent from the following detailed description taken in conjunction with the drawings.

DESCRIPTION OF THE PREFERRED EMBODIMENTS

Figure 1:
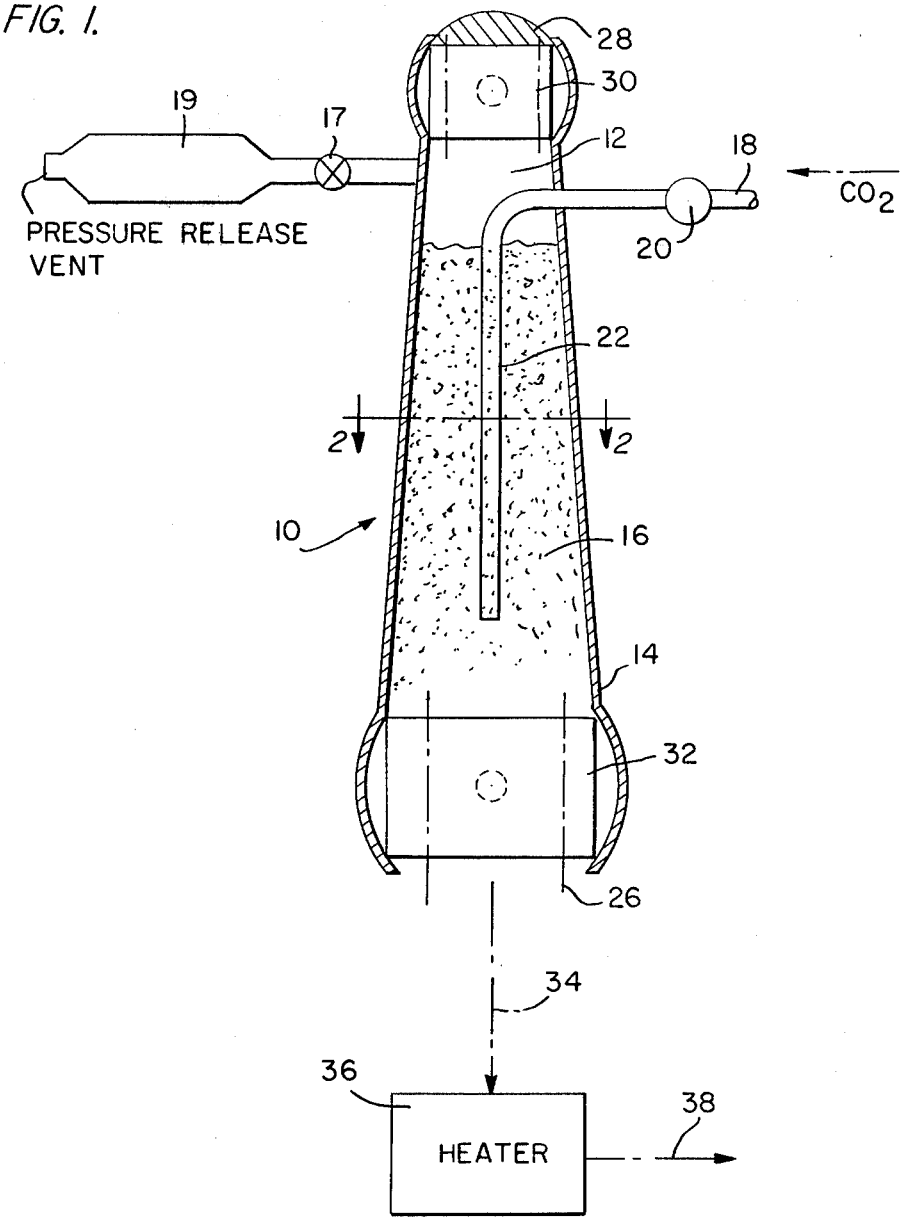
FIG. 1 diagrammatically illustrates the method and apparatus of the present invention wherein the pressure vessel is depicted in half-section.

FIG. 1 illustrates pressure reaction vessel 10 slightly tapered outwardly from an upper vessel location 12 to a lower vessel location 14, the taper serving as a convenient means for removing tobacco 16 following processing. It is found that the taper allows easy removal of the processed tobacco. The tobacco is sprayed by liquid and gaseous carbon dioxide passing from a convenient source (not shown) through tubing 18 by way of control valve 20 to a location within the pressure vessel where the tubing joins elongated conduit 22 having a large number of exit outlets 24 for spraying liquid carbon dioxide throughout the mass of contained tobacco.

A particularly suitable form of conduit for introducing the liquid carbon dioxide into the mass of tobacco consists of porous tubing made of sintered stainless steel which may be obtained from Mott Metallurgical Corporation on Pall Trinity Micro Corporation. Tubing with a variety of pore diameters is available, but one having approximately 20 microns pore diameter produces a fine fog or mist of carbon dioxide that allows unusually uniform impregnation of the tobacco with carbon dioxide. While it is preferable that the sparge tube extend into the mass of tobacco as illustrated schematically in FIG. 1, good results may also be realized when this spray unit is situated above the tobacco bed.

Although one conduit member 22 is illustrated, it is recognized that a plurality of such spray units may be included depending upon the diameter of the vessel as well as the degree of saturation desired when spraying the liquid carbon dioxide throughout the contained mass of tobacco.

In operation, lower ball valve 26 is initially in the closed position illustrated and tobacco is introduced into the pressure vessel 10 by means of ball valve 28 when in phantom position illustrated by lines 30. After the tobacco has been introduced, ball valve 28 is returned to the closed position illustrated as shown in FIG. 1. The amount of tobacco introduced into the pressure vessel 10 may vary as desired. It is recognized that a pre-weighed amount is desirably introduced so that the proportion of liquid carbon dioxide sprayed onto the tobacco can be controlled.

After ball valve 28 is closed, the vessel is pressurized either by introducing liquid and gaseous carbon dioxide into the vessel or by pre-pressurizing using an inert gas as the pressurizing medium. The liquid and gaseous carbon dioxide is introduced by spraying liquid carbon dioxide into the mass of tobacco within pressure vessel 10. Following the spraying sequence, the pressure within the vessel is held for a period and then reduced to a suitable level by means of valve 17 in pressure release vent 19 at which time the vessel may be opened for release of the tobacco by lower ball valve 26 when in phantom position 32. The removed tobacco having carbon dioxide impregnated therein is passed by line 34 to a heater 36 from which the expanded tobacco is received by line 38.

Figure 2:
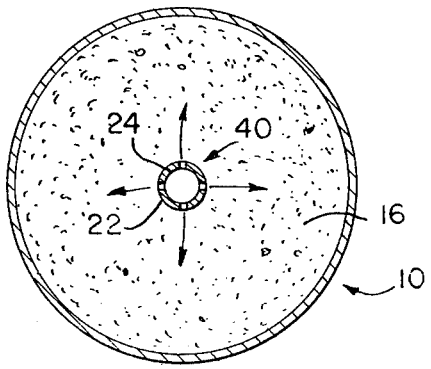
FIG. 2 is a cross-sectional view of the pressure vessel of FIG. 1 taken along lines 2—2.

FIG. 2 further illustrates the sequence of operation of FIG. 1 taken along section line 2—2 depicting the spraying of liquid carbon dioxide by lines 40 into the mass of tobacco 16 within pressurized vessel 10.

The internal pressure and temperature of the vessel used to contain the tobacco during spray impregnation of liquid carbon dioxide may vary. The pressure, for example, may vary from as low as about 250 psig. to as high as about 600 psig. Preferred pressures range from about 325 psig. to about 460 psig.

The internal temperature of the vessel will vary from about −8° F. to about 56° F. and preferably about 7° F. to about 28° F.

After the liquid carbon dioxide impregnated tobacco is removed from the vessel, it is transferred to a dryer to effect rapid release of the cabon dioxide. In order to avoid premature release of the carbon dioxide, it is necessary to limit the transfer time between removal of the tobacco from the vessel and the heat processing step. A transfer time within about 30 minutes has been found sufficient and desirably less than about one minute is preferred.

The desired temperature of the heating fluid within the dryer is dependent upon the residence time for the tobacco. Using a gas-fired dryer with a residence time of up to two minutes, heating fluid temperatures of about 200° F. to 450° F. have been found to be sufficient.

Typical moisture contents of the tobacco vary between about 10% and about 26% by weight. Also, advantage may be realized by including a volatile organic liquid solvent such as methanol, ethanol, methyl acetate, ethyl acetate, or the like in the tobacco. These volatile organic liquid solvents not only aid in causing larger amounts of liquid and gaseous carbon dioxide to be impregnated into the tobacco but also lower the freezing point of the fluids within the tobacco tissue permitting impregnation at lower temperatures and pressures without the tobacco freezing. They also impart better handling characteristics to the final product.

The amounts of volatile organic liquid solvent which may be used vary from 0 to 23% or more by weight of the tobacco being processed.

After the liquid and gaseous carbon dioxide has been sprayed into the mass of tobacco, it has been found that a holding period of time prior to release of pressure from the vessel permits greater absorption of the carbon dioxide and correspondingly larger expansion.

The amount of carbon dioxide which is sprayed into the tobacco may be varied. It is found that treating the tobacco with about 80% to about 200% by weight of liquid and gaseous carbon dioxide provides an optimum range for practice of the present method in a pressure vessel having a volume of approximately 4.4 cubic feet.

It is also possible to add selected humectants to the tobacco prior to treating it with carbon dioxide. Examples of useful humectants include glycerin, propylene glycol, triethylene glycol and the like in amounts up to 8% by weight of the tobacco. These also tend to lower the freezing point of the tobacco.

Selective surfactants or the like may be added in amount up to 3% by weight to the tobacco prior to effecting expansion. Preferably the surfactants are added in amounts less than 1% by weight. Representative examples of such surfactants include octanol, Tergitol (a nonionic surfactant made by Union Carbide Corporation representing a class of polyethylene glycol ethers of linear alcohols), lauryl alcohol, and Tween 20 (a nonionic surfactant by ICI America, Inc., representing polyoxyethylene sorbitan monolaurate) or the like.

Practice of the present invention will become more apparent from the following examples wherein all parts are given by weight unless otherwise indicated.

EXAMPLE 1

A 120 g. charge of shredded tobacco, at 14% moisture, was introduced into a two liter pressure vessel (Parr) and sealed. The vessel was purged by running carbon dioxide through the vessel at a pressure of 100 psig. for one minute. Carbon dioxide was supplied from a "Dip Tube" type cylinder and introduced into the vessel through a vertical perforated sparge tube that extended to within 2 cm. of the bottom of the vessel. After purging, the pressure was released to atmospheric and the exit vent closed. Carbon dioxide was sprayed on the tobacco, by means of the sparge tube, until a pressure of 400 psig. was reached. The vessel was maintained at 400 psig. for three minutes before venting to atmospheric pressure. During venting solid carbon dioxide snow or "frosted" tobacco formed and this was passed into a gas-fired Jetstream dryer having a fluid temperature of 250° F. A residence time of about 0.05 seconds was sufficient to achieve an expansion of 145% when measured by apparent specific gravity using tetrahydrofuran as the immersion liquid.

EXAMPLE 2

A 120 g. charge of tobacco at 12.8% moisture with 20% added alcohol was treated with carbon dioxide in a pressure vessel as described in Example 1. The purge time was 30 seconds, pressure was 400 psig., holding time was 3 minutes, and dryer fluid medium temperature was 300° F. Expansion was again measured by the apparent specific gravity technique and found to be 145%.

EXAMPLES 3–11

The procedure of Example 2 was repeated except that ingredients added, purge time, hold time and dryer fluid medium temperatures were as shown in Table I.

TABLE I

| Example No. | Tobacco at 12.8% Moisture Plus Listed Ingredients | Dryer Temp. (°F.) | Purge Time at 100 psig. (sec.) | Hold Time at 400 psig. (min.) | Expansion (Measured by apparent specific gravity) (%) |
|---|---|---|---|---|---|
| 3 | 10% Water + 5% Propylene Glycol | 200 | 30 | 3 | 32 |
| 4 | 5% Water + 5% Ethanol | 250 | 30 | 3 | 110 |
| 5 | 5% Water + 5% Ethanol | 250 | 0 | 3 | 105 |
| 6 | 10% Water + 10% Ethanol | 250 | 0 | 3 | 86 |
| 7 | 17% Water + 3% Glycerin | 250 | 30 | 5 | 60 |
| 8 | 17% Water + 3% Glycerin | 300 | 30 | 3 | 108 |
| 9 | 15% Water + 5% Ethanol + 3% Glycerin | 300 | 30 | 3 | 70 |
| 10 | 20% Water + 5% Glycerin | 350 | 30 | 5 | 137 |
| 11 | 20% Ethanol + 3% Glycerin | 250 | 30 | 3 | 141 |

EXAMPLE 12

The procedure of Example 4 was repeated except that tobacco having a moisture content of 11.5% and a "U"-type gas-fired dryer such as shown in U.S. Pat. No. 4,044,780 were used. The hold time was shortened to 2.5 minutes. Expansion under these conditions as measured by apparent specific gravity was 104%.

EXAMPLE 13

Twenty-five pounds of cut blended tobacco having a moisture content of 15% and an ethanol content of 5% was introduced into a 4.4 cubic foot tapered pressure vessel such as that shown in FIG. 1. During about 30 seconds the vessel was purged with 5 to 8 pounds of carbon dioxide while maintaining 100 psig. pressure. Carbon dioxide was supplied from the two "Dip Tube" type cylinders and introduced into the pressure vessel by means of a vertical perforated sparge tube that extended to within four inches of the lower ball valve 26. The pressure was reduced to atmospheric pressure after purging. The exit vent was closed and about 30 pounds of carbon dioxide was sprayed into the tobacco by means of the sparge tube while the pressure increased to about 400 psig. This pressure was maintained for approximately 15 minutes before venting to the atmospheric pressure. During the time required for venting, about 30 seconds, solid carbon dioxide was formed. The tobacco "frosted" with solid carbon dioxide was placed in a rapidly moving conveyor and fed into the gas-fired "U"-type dryer of Example 12 having a fluid temperature of about 400° F. Heat from the dryer immediately vaporized the solid carbon dioxide, thereby expanding the cut tobacco by about 94% as measured by the change in apparent specific gravity.

EXAMPLE 14

The procedure of Example 13 was repeated except that the tobacco contained 15% more moisture, 3% ethanol, and 2% glycerin. The tobacco expansion was 104% as measured by the change in apparent specific gravity.

EXAMPLE 15

Figure 3:
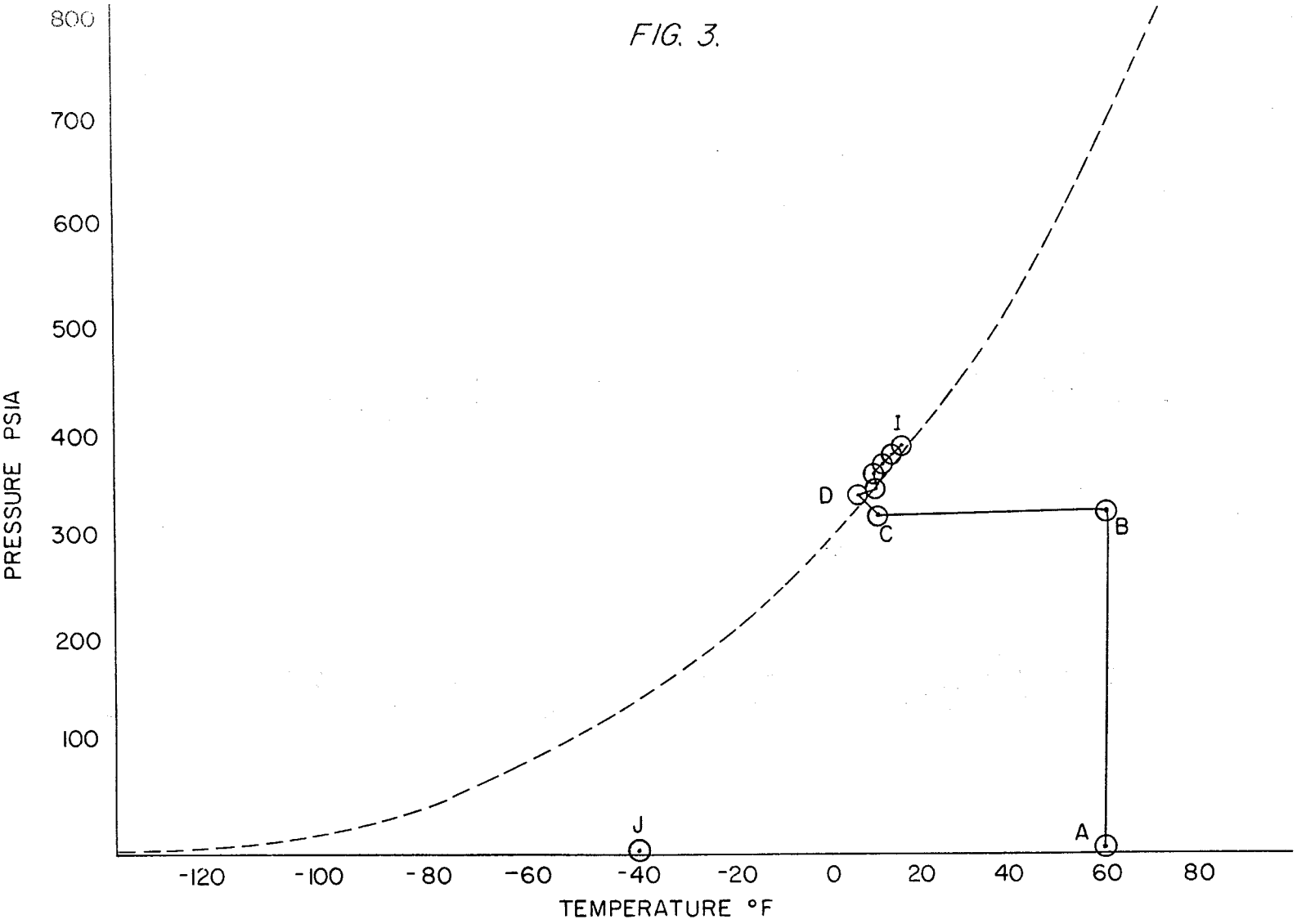
FIG. 3 is a chart reflecting pressure versus temperature for the results of Example 15.

The procedure of Example 14 was repeated except that 2% propylene glycol was substituted for the 2% glycerin. In this experiment temperature and pressure measurements were followed for a period of 15 minutes. Results are shown in FIG. 3. The addition of 30 pounds of carbon dioxide during 1.5 mins. ("A" to "B") gave a pressure of 330 psig. The temperature dropped rapidly to "C" as equilibrium conditions were approached. Then as the vessel was slowly allowed to warm-up, the pressure and temperature increased as anticipated following the temperature-vapor pressure curve "D"-"I" reaching "I" after 15 minutes lapsed time. After the vessel was vented to atmosphere the final temperature of the "frosty" tobacco was −39° F. as indicated by "J". Expansion measured as indicated above was 84%.

EXAMPLE 16

Twelve pounds of cut blended tobacco containing 21% moisture and 5% glycerin was introduced into a 4.4 cubic foot pressure vessel. The vessel was purged with carbon dioxide at 70 psig. for 45 seconds and then brought to atmospheric pressure. Then carbon dioxide was supplied and introduced into the vessel as described in Example 13. After purging, sufficient carbon dioxide was added to give a pressure of 450 psig. which was maintained for three minutes. The vessel was vented to atmospheric pressure and the "frosty" tobacco fed into the "U"-type dryer of Example 12 maintained at 400° F. Expansion was 51%. Tobacco analyses for the tobacco before and after expansion are shown below:

| | Sample Before Expansion | Sample After Expansion |
|---|---|---|
| Total Volatile Bases as Ammonia (%) | 0.56 | 0.55 |
| Total Alkaloids as Nicotine (%) | 2.52 | 2.47 |
| Total Reducing Sugars as Dextrose (%) | 7.4 | 7.3 |
| Ash (%) | 17.65 | 17.40 |
| pH | 5.5 | 5.5 |

These results show no significant changes in major tobacco components as a result of the expansion.

EXAMPLE 17

Twenty-five pounds of cut blended tobacco at 18% moisture and containing 5% added ethanol was introduced into a 4.1 cubic foot tapered pressure vessel similar to FIG. 1. The vessel was pre-pressurized to 250 psig. with gaseous carbon dioxide before spraying 34 pounds of liquid carbon dioxide onto the tobacco by means of the sparge tube as described in Example 13. Carbon dioxide was stored in a six-ton refrigerated tank system that was capable of supplying both gas and liquid to the pressure vessel. A pressure of 370 psig. was obtained and the tobacco held under pressure for three minutes before venting to the atmosphere. The tobacco was removed from the pressure vessel and fed into the "U"-type dryer of Example 12. In this manner an expansion of 98% was obtained when measured by the change in apparent specific gravity.

EXAMPLE 18

Twenty-five pounds of cut blended tobacco at 18% moisture and containing 5% added ethanol was introduced into the pressure vessel described in Example 17. The vessel was purged and pressurized as described in Example 13 except that 34 pounds of carbon dioxide was used to give a pressure of 470 psig. Carbon dioxide was supplied by the refrigerated system described in Example 17. The temperature of the in-going liquid was maintained at about 10° F. (between 0° and 20° F.). The tobacco was held under pressure for six minutes before decreasing pressure to atmospheric and heating as described in Example 12. These conditions were sufficient to impart an expansion of 92% when measured by the change in apparent specific gravity.

EXAMPLE 19

Thirty pounds of cut blended tobacco at 15% moisture and containing 5% added ethanol was introduced into the pressure vessel described in Example 17. The vessel was pre-pressurized to 200 psig. with gaseous carbon dioxide before 57 pounds of liquid carbon dioxide was added through a 1½ inch by 6 inch sintered stainless steel sparge tube located above the tobacco. This sparge tube delivers the carbon dioxide to the tobacco in the form of a fine fog or mist. Carbon dioxide was supplied by the refrigerated system described in Example 17. The vessel pressure was 395 psig. immediately after the addition of carbon dioxide and rose to 450 psig. during a nine minute hold time. Carbon dioxide was then vented, the pressure decreased to atmospheric, the tobacco was removed from the pressure vessel and heated as described in Example 12. Tobacco expansion was 112% as measured by the change in apparent specific gravity.

While the invention has been described in connection with the preferred embodiments, it is not intended to limit the invention to the particular forms set forth, but, on the contrary, it is intended to cover such alternatives, modifications, and equivalents as may be included within the spirit and scope of the invention as defined by the appended claims.

What is claimed is:

1. A method for expanding tobacco tissue which comprises impregnating tobacco tissue in a confined vessel wherein the internal temperature is about −8° F. to about 56° F. with carbon dioxide by contacting the tobacco tissue with a mist of carbon dioxide including a mixture of liquid and gaseous constituents, removing the impregnated tobacco tissue from the confined vessel, heating the impregnated tobacco tissue to effect rapid release of the carbon dioxide, and recovering expanded tobacco tissue.

2. The method of claim 1 wherein the tobacco tissue is confined in a pressurized vessel and the carbon dioxide is sprayed into the vessel for substantially uniform impregnation of the mass of tobacco tissue therein.

3. The method of claim 1 wherein the tobacco is introduced into the vessel, through a pressure containing valve and wherein the impregnated tobacco is removed from the vessel through a pressure containing valve.

4. The method of claim 1 wherein the vessel is pre-pressurized by means of an inert gas.

5. The method of claim 1 wherein the vessel is pressurized between about 250 psig. to about 600 psig.

6. The method of claim 2 wherein the pressure is about 325 psig. to about 460 psig.

7. The method of claim 1 wherein the internal temperature of the vessel is about 7° F. to about 28° F.

8. The method of claim 1 wherein rapid release of carbon dioxide from the impregnated tobacco tissue is effected within 30 minutes following release from the vessel.

9. The method of claim 8 wherein the rapid release is effected within 1 minute following release from the vessel.

10. The method of claim 1 wherein the temperature during heating the impregnated tobacco tissue is about 200° F. to 450° F.

11. The method of claim 1 wherein the moisture content of the tobacco is about 10% to about 26% by weight.

12. The method of claim 1 wherein the tobacco is treated with about 80% to about 200% by weight of carbon dioxide.

13. A method for expanding tobacco tissue which comprises impregnating tobacco tissue with carbon dioxide by contacting the tobacco tissue with a mist of carbon dioxide in a confined vessel pre-pressurized by means of an inert gas, removing the impregnated tobacco tissue from the confined vessel, heating the impregnated tobacco tissue to effect rapid release of the carbon dioxide, and recovering expanded tobacco tissue.

* * * * *

UNITED STATES PATENT AND TRADEMARK OFFICE

CERTIFICATE OF CORRECTION

PATENT NO. : 4253474

DATED : March 3, 1981

INVENTOR(S) : Charles H. Hibbitts; Byron F. Price; Everett C. Cogbill; James G. Kelly and James E. Glass It is certified that error appears in the above-identified patent and that said Letters Patent are hereby corrected as shown below:

Column 2, line 2, "presure" should be --pressure--.

Line 51, "on" should be --or--.

Column 4, line 19, "amount" should be --amounts--.

Line 50, "0.05" should be --0.5--.

Column 5, line 56, "more" should be deleted.

Column 8, line 13, delete the comma (,) after "vessel".

Signed and Sealed this

Sixteenth Day of June 1981

[SEAL]

*Attest:*

RENE D. TEGTMEYER

*Attesting Officer*

*Acting Commissioner of Patents and Trademarks*